US005685748A

United States Patent [19]

Harting et al.

[11] Patent Number: 5,685,748

[45] Date of Patent: Nov. 11, 1997

[54] CONTACT SPRING

[75] Inventors: Dietmar Harting, Espelkamp; Gunter Pape, Bielefeld; Karin Forster, Lubbecke, all of Germany

[73] Assignee: Harting Elektronik GmbH, Germany

[21] Appl. No.: 583,158

[22] Filed: Jan. 4, 1996

[30] Foreign Application Priority Data

Nov. 10, 1995 [DE] Germany ..... 195 41 953.7

[51] Int. Cl.[6] ..... H01R 4/48

[52] U.S. Cl. ..... 439/862; 439/839

[58] Field of Search ..... 439/851–862, 439/839, 849, 850

[56] References Cited

U.S. PATENT DOCUMENTS 4,262,986 4/1981 Cherian et al. ..... 439/862

5,213,530 5/1993 Uratsuji ..... 439/856

5,252,097 10/1993 Lindeberg et al. ..... 439/856

*Primary Examiner*—David L. Pirlot

*Attorney, Agent, or Firm*—Dorn, McEachran, Jambor & Keating

[57] ABSTRACT

For a unilaterally contacting contact spring for electric connectors, it is proposed to influence the contact force of the spring limb by means of an adjusting spring which acts upon the spring limb. As a result, a high contact pressure is already achieved upon slight deflection of the spring limb and, upon maximum deflection, the characteristic curve of the spring presents a flatter shape so that the contact force does not assume excessively high values.

4 Claims, 1 Drawing Sheet fig.1.
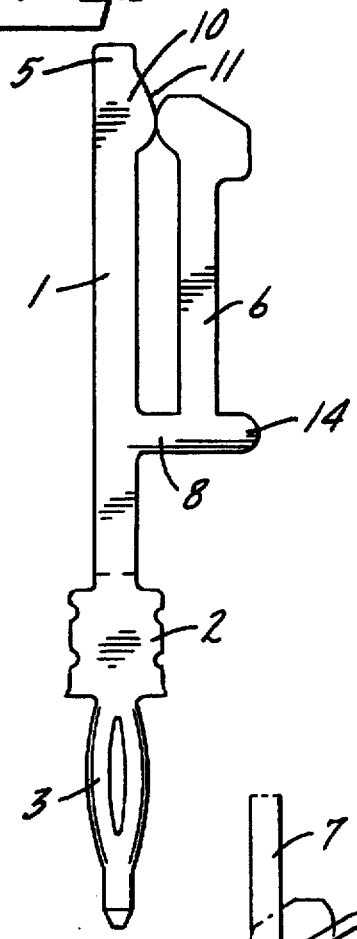
fig.2.
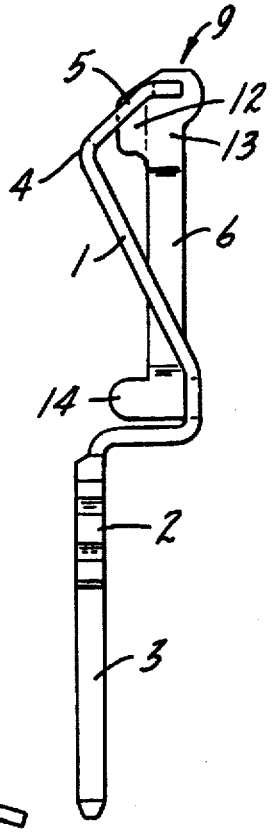
fig.3.
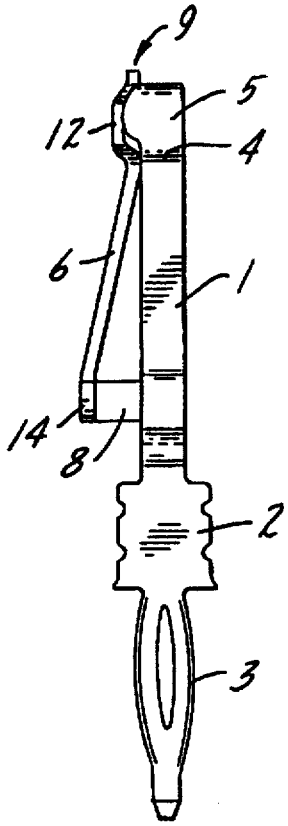
fig.5.
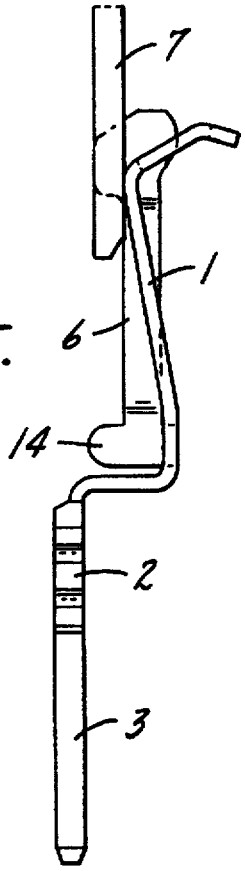
fig.4.
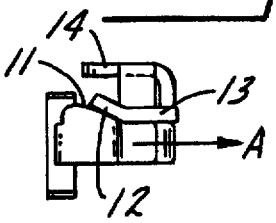
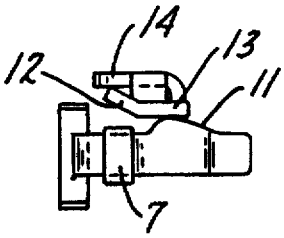
fig.6.

CONTACT SPRING

THE FIELD OF THE INVENTION

The invention relates to a contact spring for electrical connectors which is designed as a unilaterally contacting spring and manufactured from flat spring material, the contact spring comprising a resilient spring limb with a top contacting region for contact with a contact point of a mating connector.

Such contact springs are used in electrical connectors, the contact springs being arranged in rows and gaps in an insulating body. When a suitable mating connector with blade-type contact elements is inserted, the contact blades are pushed into the connectors provided with the contact springs, the contact springs pressing with an initial stress against the blade contacts and thereby establishing the electrical connections. During said process, on the one hand, sufficient contact pressure for trouble-free electrical contacting has to be ensured by an appropriate bias of the contact springs and, on the other hand, the total force required to push in the blade contacts in multipole connectors should not assume excessively high values.

Electrical connectors with unilaterally contacting springs are generally known. With such connectors it is known to ensure, by means of an appropriate bias and selection of the material of the contact springs, that a sufficiently high contact pressure is already exerted upon the blade contacts upon slight deflection of the spring limbs of the contact springs. What however then arises is that, upon greater deflection of the spring limbs, the contact force assumes very high values, i.e. the force for insertion of a multipole mating connector assumes values which are no longer acceptable.

SUMMARY OF THE INVENTION

The object of the invention is to design a contact spring of the type described initially in such a way that a sufficiently high contact pressure is already achieved upon slight deflection of the spring limb and at the same time, upon extensive deflection of the spring limb, the contact pressure and hence the total insertion force of the connector does not assume excessively high values.

Said object is achieved in that an adjusting spring made of flat, resilient material is provided alongside the spring limb, that the adjusting spring is arranged in such a way that its spring direction is at right angles to the spring limb and that the top end of the adjusting spring rests and/or presses with initial stress resiliently against the narrow side of the spring limb at the latter's top end.

The advantages achieved by the invention are in particular that the normally linearly ascending characteristic curve of the spring limb of a contact element is influenced in such a way that an initially steeply ascending area of the characteristic curve upon slight deflection is followed by a flatter area upon extensive deflection.

By virtue of differently progressive bending contours of the adjusting spring provided for influencing purposes, progressive contact forces may likewise be achieved. The bending contour of the adjusting spring may be formed in such a way that, upon slight deflection, the contact pressure is relatively high and, upon maximum deflection, the permissible total insertion force is still observed.

According to an advantageous refinement of the invention, the adjusting spring may be manufactured as an integral part of the contact spring, the contact element as a whole being punched out of a flat spring material and through a bending operation being formed into the contact spring with the adjusting spring arranged alongside.

BRIEF DESCRIPTION OF THE DRAWINGS

The invention is illustrated diagrammatically in the following drawings wherein:

FIG. 1 is a plan view of a punched blank of the contact spring;

FIG. 2 is a side view of the contact spring;

FIG. 3 is a front view of the contact spring;

FIG. 4 is a top view of the contact spring;

FIG. 5 is a side view of the contact spring with deflected spring limb; and

FIG. 6 is a top view of the contact spring according to FIG. 5.

DESCRIPTION OF THE PREFERRED EMBODIMENT

The contact spring shown in FIGS. 1–7 is punched out of flat spring material, the punched blank being shown in FIG. 1. The contact spring comprises a spring limb 1, a substantially rectangular mounting portion 2 for mounting in a suitable recess of an insulating body (not shown here) and a bottom connection region 3 for connection to a printed circuit board. The connection region here takes the form of a press-fit zone for pressing into plated holes of the printed circuit board.

As FIG. 2 shows, above the mounting portion the top piece of the contact spring comprising the spring limb 1 is first bent substantially at right angles and then bent back in such a way that the contacting region 4 is situated approximately in the plane of the mounting portion 2. To form the contacting region, the top end 5 of the spring limb is provided with a bend, which also serves as a run-up slope for the mating contact 7, FIG. 5.

The contact element further comprises an adjusting spring 6, which acts upon the spring limb 1 in such a way that the normally uniform shape of the characteristic curve of the spring—i.e. upon slight deflection, the contact pressure exerted by the spring limb upon a mating contact 7 is low and rises linearly with increasing deflection—is influenced in such a way that, already upon slight deflection, a relatively high contact pressure is achieved, which then no longer rises with increasing deflection.

The adjusting spring 6 is connected by a strip of material 8 to the spring limb 1, i.e. is manufactured as an integral part of the spring limb.

The adjusting spring is bent in such a way that its flat side is situated next to the spring limb and its top end 9 presses resiliently against the narrow side of the spring limb.

It is provided that the top end 5 of the spring limb 1 is provided with a widened portion 10 which has a curved contour 11. Furthermore, the top end 9 of the adjusting spring 6 is provided with an oblique surface 12, which is produced by suitable bending and adjoining which is a region 13 remaining parallel to the narrow side of the spring limb.

As is evident from FIG. 4, in the position of rest of the spring limb the oblique surface 12 of the adjusting spring is applied with a specific initial stress against the start of the contour 11 of the spring limb 1. Upon deflection of the spring limb, i.e. upon insertion of a mating contact in arrow direction A, the contour 11 slides along the oblique surface and finally passes into the straight region 13 (see FIG. 6).

The effect thereby achieved is that the contact force, i.e. the force exerted by the contacting region 4 upon the mating contact 7, is already great upon slight deflection of the spring limb, i.e. is greater than in the case of a spring limb without an adjusting spring, and upon greater deflection again assumes values which are determined solely by the spring force of the spring limb.

By suitably fashioning the contour, the setting angle of the oblique position and the bias of the adjusting spring it is therefore possible to determine the resultant contact force upon the mating contact.

All in all, a relatively high contact pressure may therefore already be achieved upon slight deflection and, upon maximum deflection, it is still possible to keep within the maximum allowable contact pressure in view of the total insertion force of a multi-pole connector.

To enable the adjusting spring 6 to be adjusted independently of the spring limb 1, it may be provided that the strip of material 8 connecting the adjusting spring to the spring limb has a lateral extension 14. Said extension then engages into a corresponding receiver in the insulating body and arrests the strip of material.

Whereas the preferred form of the invention has been shown and described herein, it should be realized that there may be many modifications, substitutions and alterations thereto.

The embodiments of the invention in which an exclusive property or privilege is claimed are defined as follows:

1. A contact spring for electrical connectors, which spring is manufactured from flat spring material, said contact spring comprising a resilient spring limb (1) having a top contacting region (4) for contact with a contact point of a matching connector, a top end (5) and a narrow side, characterized in that:

an adjusting spring (6) formed of a flat, resilient material is provided alongside said spring limb (1), said adjusting spring (6) is arranged so that its spring direction extends at right angles to said spring limb (1), a top end (9) is formed on said adjusting spring and engages with initial stress resiliently against said narrow side of said spring limb (1) at said top end (5) thereof, a laterally extending widened portion (10) with a curved contour (11) is formed on said top end (5) of said spring limb (1), and a curved contour, (12,13) is formed on the top end (9) of the adjusting spring (6), upon deflection of said spring limb, said curved contour (11) at said widened portion (10) thereof engages said curved contour (12,13) of said adjusting spring (6) to deflect said adjusting spring.

2. Contact spring according to claim 1, characterized in that the adjusting spring (6) is integrally connected to the contact spring.

3. Contact spring according to claim 1 characterized in that the contact pressure of the spring limb (1) is adjustable by varying the oblique surface (12) and the contour (13) of the adjusting spring.

4. Contact spring according to claim 1 characterized in that the strip of material (8) has an extension (14) by means of which the strip of material may be arrested in the insulating body.

* * * * *